US008079687B2

(12) United States Patent
Martinez et al.

(10) Patent No.: US 8,079,687 B2
(45) Date of Patent: Dec. 20, 2011

(54) HOLE CLOSURE FOR A FLUID CARTRIDGE

(75) Inventors: Adrian J. Martinez, Isabela, PR (US); Angel Soltero, San Juan, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 458 days.

(21) Appl. No.: 12/241,403

(22) Filed: Sep. 30, 2008

(65) Prior Publication Data

US 2009/0147063 A1 Jun. 11, 2009

Related U.S. Application Data

(60) Provisional application No. 60/992,901, filed on Dec. 6, 2007.

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS 4,056,116 A * 11/1977 Carter et al. ..... 137/68.3
5,353,968 A * 10/1994 Good, Jr. ..... 222/212
6,682,183 B2 * 1/2004 Jones et al. ..... 347/85

* cited by examiner

*Primary Examiner* — Stephen Meier
*Assistant Examiner* — Tracey McMillion

(57) ABSTRACT

In one embodiment, a cartridge includes: a housing having a chamber therein for holding a fluid; a hole extending through the housing to the chamber; and a breachable membrane that, in an unbreached state, substantially closes the hole, the membrane resiliently configured such that, upon being breached, the membrane rebounds to a breached state only partially closing the hole.

21 Claims, 6 Drawing Sheets

HOLE CLOSURE FOR A FLUID CARTRIDGE

This application clams the benefit of U.S. Provision Patent Application Ser. No. 60/992,901 filed on 6 Dec. 2007, which is hereby incorporated by reference in its entirety.

BACKGROUND

For some types of inkjet printer ink cartridges ink is introduced into the cartridge through one or more fill holes molded into the cartridge housing. Ink fill holes are often positioned at the top of the cartridge so that the holes may also function as vent holes for venting the ink holding chamber(s) within the housing. In one such ink cartridge, a "vent plug" is inserted into each fill hole after the cartridge is filled with ink. The vent plug substantially closes the fill hole, leaving just a small opening or gap for venting the ink chamber. Ink fill holes are typically quite small, about 1/10 inch in diameter in some cartridges, and the vent openings are significantly smaller. Accordingly, the vent plugs are also very small. Fabricating and installing the tiny vent plugs adds significantly to the cost of the ink cartridge. Also, problems are sometimes encountered fabricating and installing vent plugs due to the small size of the plugs. For example, particulate debris and deformed plugs can jam or otherwise disable the automated machinery used to make and install the plugs, causing costly downtime and repairs.

DRAWINGS

DETAILED DESCRIPTION

Embodiments of the disclosure were developed in an effort to provide an alternative to the use of vent plugs to close ink fill holes in an ink cartridge. Embodiments will be described with reference to an ink fill hole in a tri-color ink cartridge. Embodiments of the disclosure, however, are not limited to use with tri-color ink cartridges or to ink fill holes, but might also be used in other ink cartridges, other fluid cartridges or to close other openings in a cartridge. The example embodiments shown in the Figures and described below, therefore, illustrate but do not limit the scope of the disclosure.

As used in this document: "membrane" means a thin sheet or layer covering an opening or separating two adjoining areas; and "plastic" means a moldable polymer.

Figure 1:
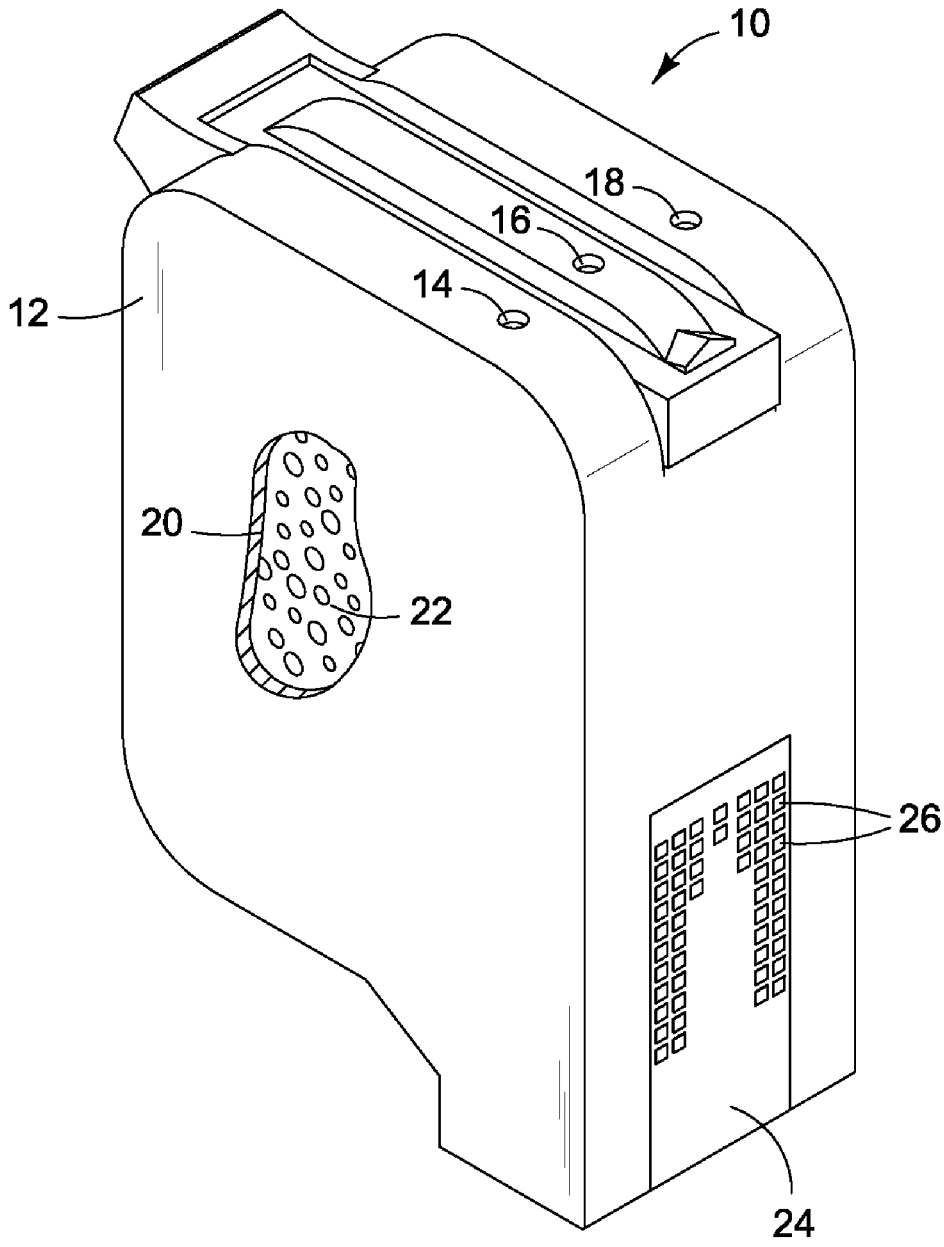
FIG. 1 is a perspective view illustrating an ink cartridge having ink fill holes, according to one embodiment of the disclosure.

FIG. 1 is a perspective view illustrating a tri-color ink cartridge 10 that includes a housing 12 enclosing three ink holding chambers. An ink fill hole 14, 16, 18 extends through the top of housing 12 to a corresponding ink holding chamber. Only one ink holding chamber 20 is visible in FIG. 1, corresponding to fill hole 14. Housing 12 may be formed as a single part or as two or more discrete parts affixed to one another. Although an ink cartridge housing such as housing 12 is typically formed by molding plastic into the desired configuration, other techniques or materials might also be used to form housing 12. Ink is held in foam 22 or another suitable porous material in chamber 20. Ink cartridge 10 also includes a printhead (not visible in FIG. 1) located at the bottom of cartridge 10 below the ink holding chambers. The printhead includes an array of ink ejection nozzles through which drops of ink are ejected at the urging of thermal or piezoelectric "firing" elements in the printhead. A flexible circuit 24 carries electrical traces from external contact pads 26 to the firing elements.

Ink cartridge 10 is just one example of a cartridge in which embodiments of the new hole closure may be implemented. Other examples include "free ink" cartridges in which there is no ink-holding material in some or all of the ink holding chambers and ink cartridges that are solely ink reservoirs (i.e., cartridges that do not include a printhead).

Figure 3:
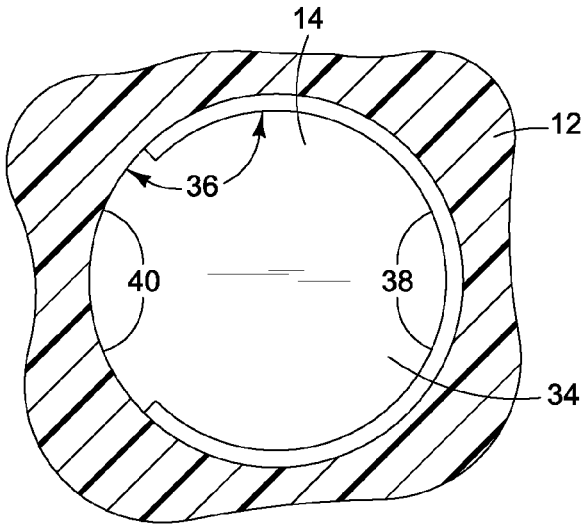
FIG. 3 is a plan section view of the ink fill hole shown in FIG. 2, taken along the line 3-3 in FIG. 2.
Figure 2:
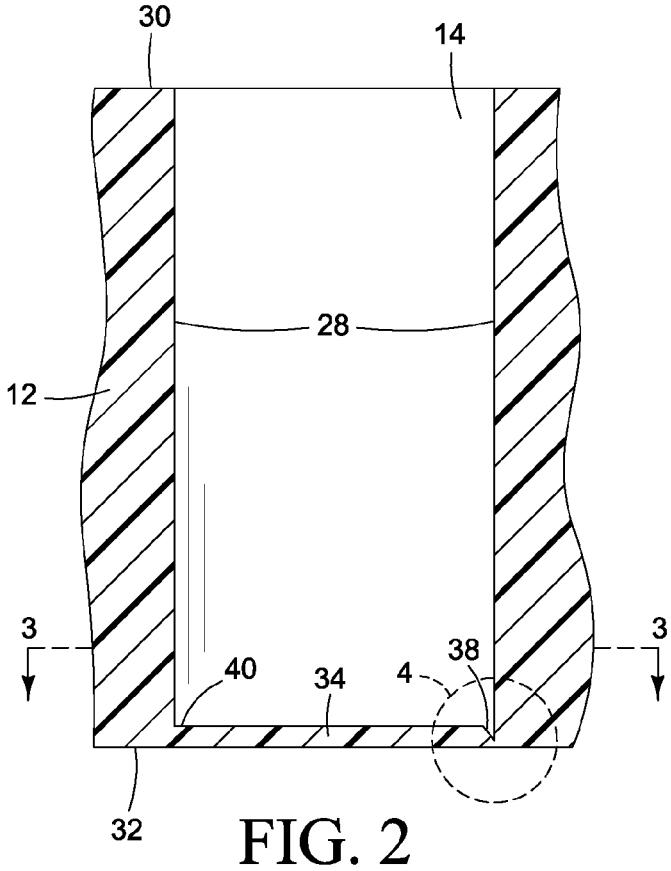
FIG. 2 is an elevation section view of an ink fill hole from the cartridge of FIG. 1, according to one embodiment of the disclosure.
Figure 4:
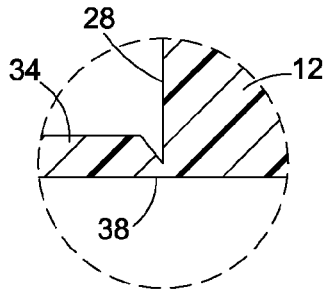
FIG. 4 is a detail section view of a portion of the ink fill hole shown in FIG. 2.

FIG. 2 is an elevation section view illustrating one example embodiment of an ink fill hole 14 in the cartridge of FIG. 1. FIG. 3 is a plan section view of fill hole 14 taken along the line 3-3 in FIG. 2. Referring to FIGS. 2 and 3, hole 14 is defined by a sidewall 28 that extends from a top end 30 at an exterior of housing 12 to a bottom end 32 at ink chamber 20 (ink chamber 20 is not shown in FIGS. 2-3). The bottom of hole 14 is closed by a membrane 34 spanning hole 14. In the embodiment shown, membrane 34 is integral to housing 12 and fully closes hole 14 until an ink fill needle is inserted into hole 14 and through membrane 34, as described below, or until membrane 34 is otherwise breached. Referring now also to the detail view of FIG. 4, a first extent of the periphery 36 of membrane 34 is thinned at the junction with sidewall 28 to form a locally weaker part 38. The thickness of membrane 34 remains fully intact along a second extent of periphery 36 to form a locally stronger part 40.

Figure 5:
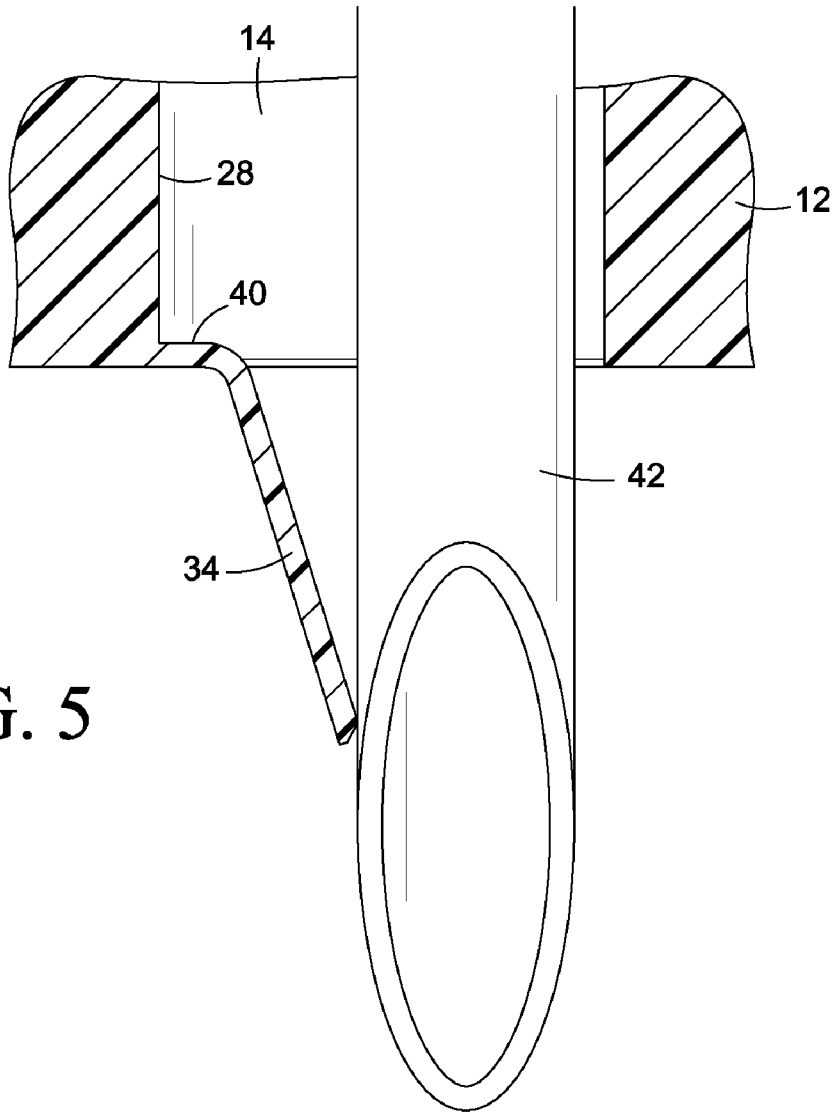
FIG. 5 is an elevation section view of the ink fill hole shown in FIG. 2 with an ink fill needle inserted into the hole breaking away the membrane at the bottom of the hole.
Figure 6:
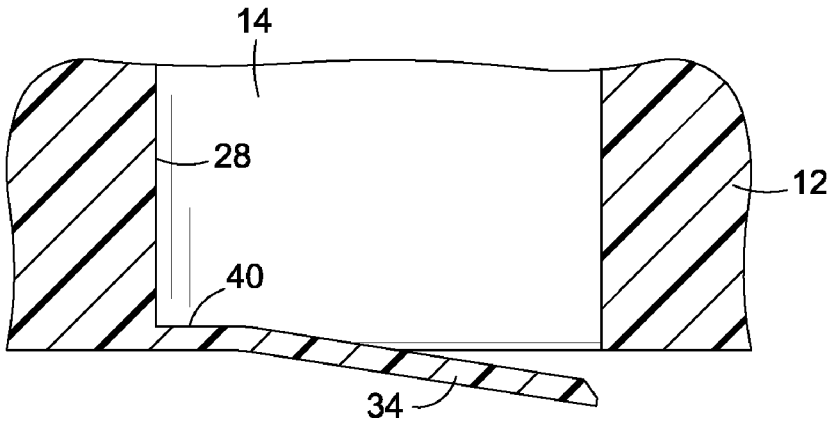
FIG. 6 is an elevation section view of the ink fill hole shown in FIG. 5 after the ink fill needle has been withdrawn from the hole.
Figure 7:
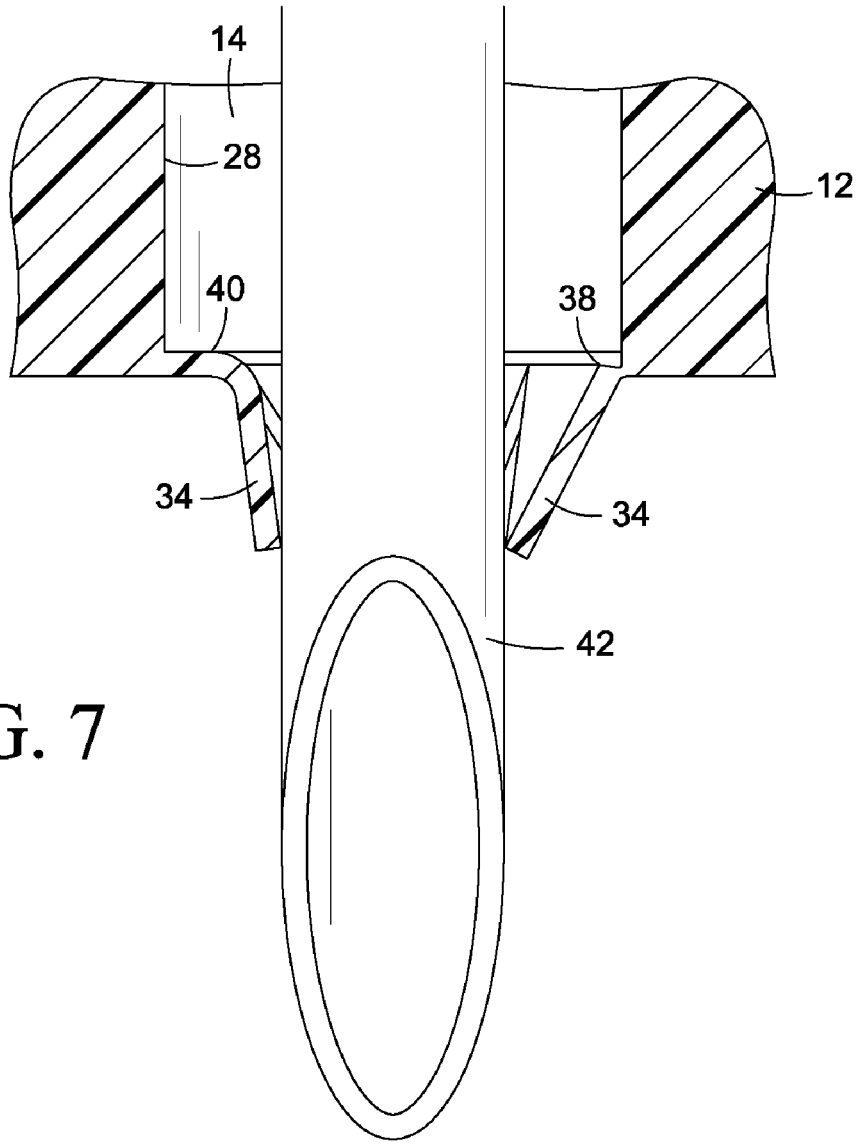
FIG. 7 is an elevation section view of the ink fill hole shown in FIG. 2 with an ink fill needle inserted into the hole puncturing the membrane at the bottom of the hole.
Figure 8:
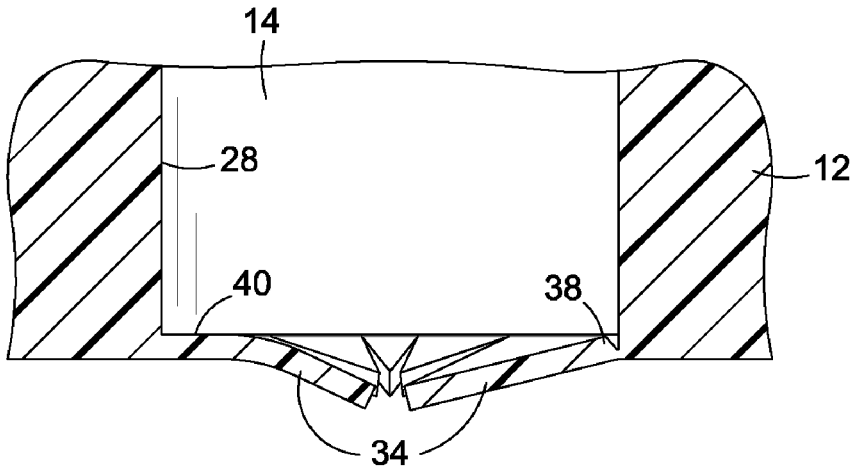
FIG. 8 is an elevation section view of the ink fill hole shown in FIG. 7 after the ink fill needle has been withdrawn from the hole.

Thus, membrane 34 is configured to break away from sidewall 28 along weaker part 38 when an ink fill needle 42 is inserted into hole 14, as shown in FIG. 5, and to rebound back toward the original, closed position at the urging of stronger part 40 when ink fill needle 42 is withdrawn from hole 14, as shown in FIG. 6. Stronger part 40 forms a living hinge on which membrane 34 swings open upon the insertion of fill needle 42 and swings back upon the withdrawal of fill needle 42. The mechanical characteristics of polyethylene terephthalate or other such plastics typically used for molding ink cartridges, along with the size and shape of stronger part 40 permit partially re-closing hole 14 upon withdrawal of fill needle 42. It is desirable that hole 14 remain open enough to allow air to pass in and out of chamber 20 through hole 14 but not so open as to allow excessive evaporative losses from chamber 20. Depending on the characteristics of fill needle 42 (e.g., size, shape/sharpness, and insertion force) the configuration of membrane 34 might also allow fill needle 42 to puncture membrane 34 upon insertion into hole 14, as shown in FIG. 7. In the case of needle puncture, the entire periphery 36 of membrane 34 acts as a living hinge to return membrane 34 toward the original, closed position when ink fill needle 42 is withdrawn from hole 14, as shown in FIG. 8.

Referring again to FIGS. 2-4, in one example configuration in which ink fill hole 14 is about 0.23 inches long and 0.11 inches in diameter, typical for an ink cartridge 10 in FIG. 1, membrane 34 has a nominal thickness in the range of 0.005 inches to 0.015 inches. An ink fill needle used in an automated ink fill process typically exerts enough pressure to puncture a layer of molded polyethylene terephthalate up to about 0.040 inches thick. Thus, a plastic membrane 34 in the range noted above should be easily punctured in an automated ink fill process. Also, where it is desirable to weaken a membrane 34 to allow the membrane to break away upon insertion of the ink fill needle, membrane 34 may be beveled or otherwise thinned at weaker part 38 to a thickness in the range of 0.002 inches to 0.005 inches along about 270 degrees of its periphery 36, leaving stronger part 40 along about 90 degrees of periphery 36. In the example configuration shown in FIGS. 2-4, therefore, weaker part 38 is likely to fail significantly sooner than stronger part 40 and before membrane 34 is punctured but membrane 34 is also sufficiently thin to allow membrane puncture without damaging the fill needle or other fill tooling in the event the beveled weaker part 38 does not fail upon needle insertion. Also, in this example configuration, for an ink fill needle about 0.05 inches in diameter (about ½ the diameter of hole 14) membrane 34 is resiliently configured such that it will rebound to close at least 80% of a cross sectional area of hole 14.

Figure 10:
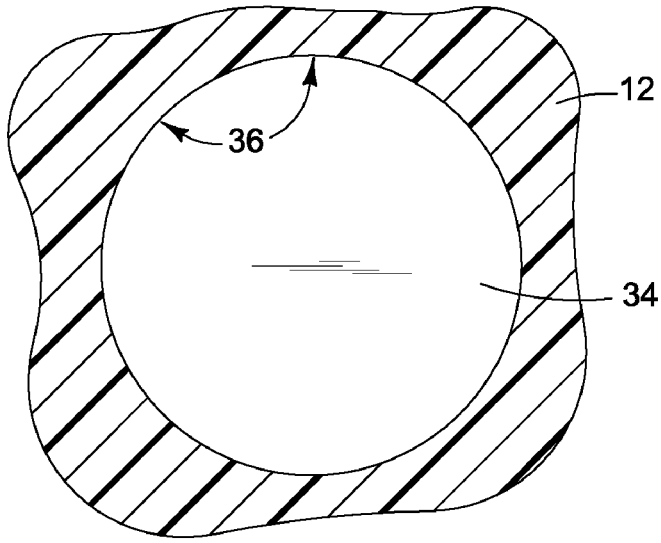
FIG. 10 is a plan section view of the ink fill hole shown in FIG. 9 taken along the line 10-10 in FIG. 9.
Figure 9:
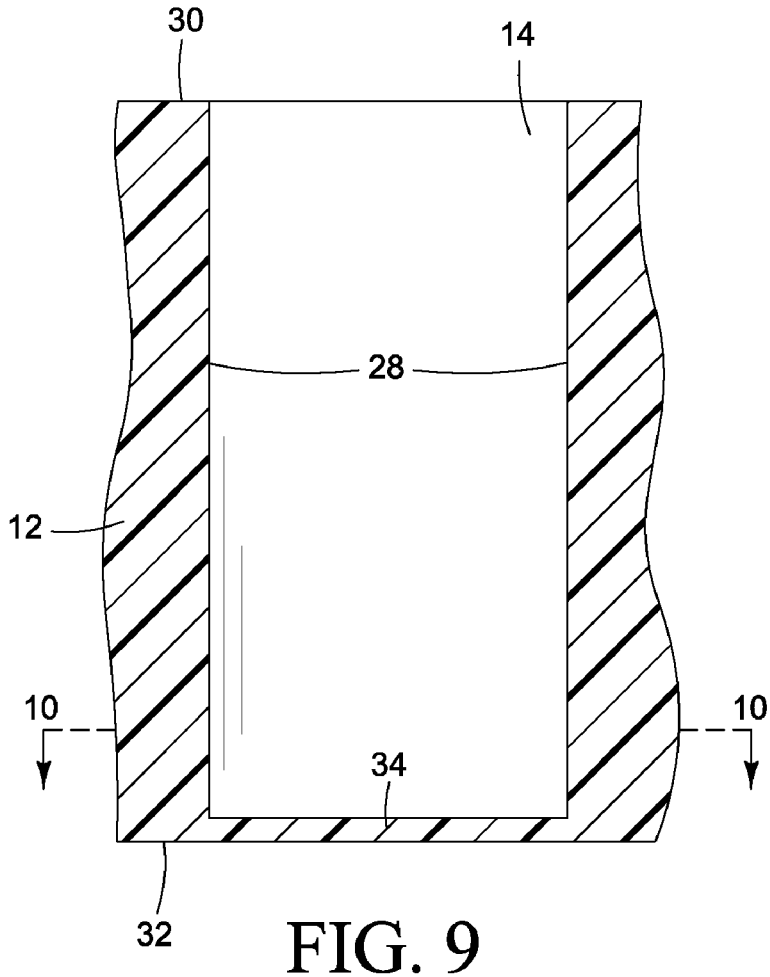
FIG. 9 is an elevation section view of an ink fill hole from the cartridge of FIG. 1, according to a second embodiment of the disclosure.
Figure 11:
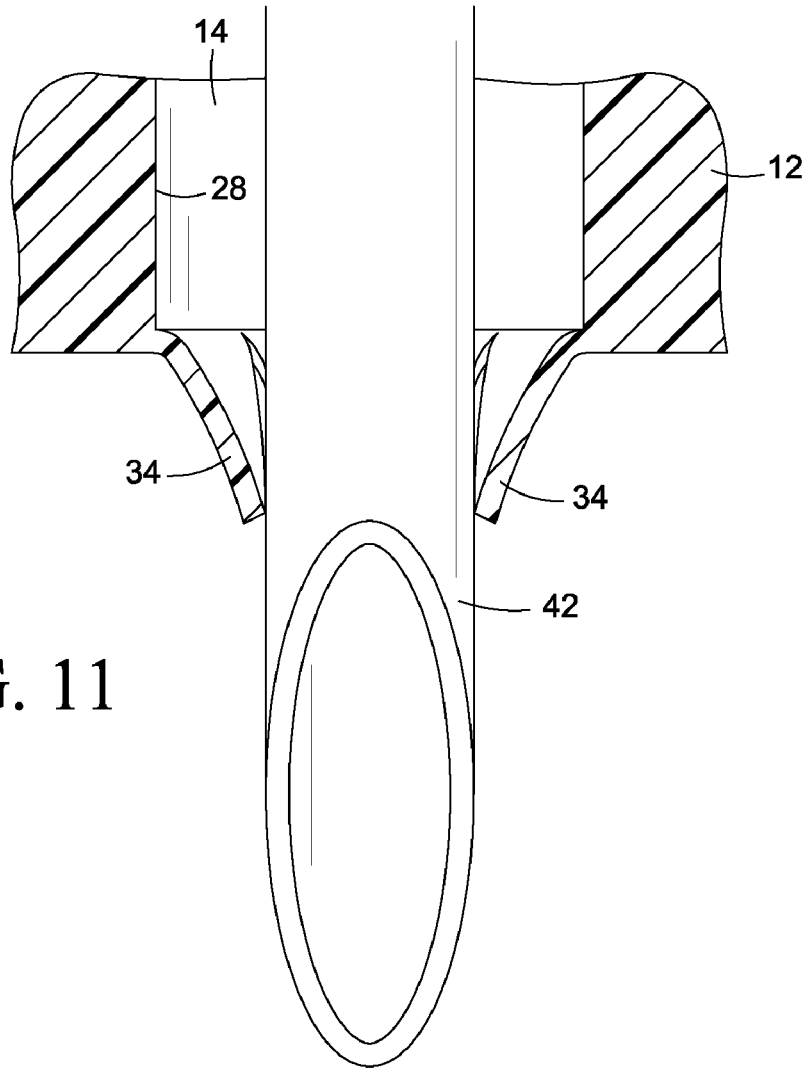
FIG. 11 is an elevation section view of the ink fill hole shown in FIG. 9 with an ink fill needle inserted into the hole puncturing the membrane at the bottom of the hole.
Figure 12:
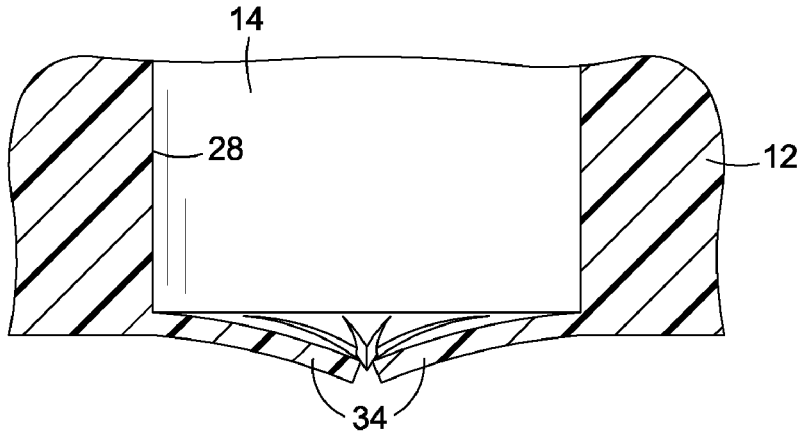
FIG. 12 is an elevation section view of the ink fill hole shown in FIG. 11 after the ink fill needle has been withdrawn from the hole.

In the embodiment shown in FIGS. 9-12, membrane 34 is configured for needle puncture only. Referring first to FIGS. 9 and 10, membrane 34 has a uniform thickness along its entire periphery 36. Thus, membrane 34 is configured so that fill needle 42 punctures membrane 34 when an ink fill needle 42 is inserted into hole 14, as shown in FIG. 11, and the entire periphery 36 of membrane 34 acts as a living hinge to return membrane 34 toward the original, closed position when ink fill needle 42 is withdrawn from hole 14, as shown in FIG. 12.

Although it is expected that membrane 34 will usually be molded as an integral part of cartridge housing 12, it may be possible to form membrane 34 using other fabrication techniques. For example, membrane 34 might be formed with a secondary molding operation or by welding or staking a thin plastic sheet over hole 14. It may be desirable in some ink cartridges to form membrane 34 at the top end 30 of hole 14, or at some intermediate location between the top end 30 and the bottom end 32 of hole 14. Also, while it is expected that membrane 34 will usually fully close hole 14 until breached, for some ink cartridges membrane 34 may substantially but not fully close hole 14 due to, for example, perforating the periphery of membrane 34. Perforations may be desirable in any event to reduce or otherwise control the force needed to breach membrane 34. Thus, the claims recite a membrane that "substantially closes" or a membrane "substantially closing" the hole to cover those cartridges in which a membrane in the "unbreached" or "formed" state may not always fully close the hole.

The article "a" as used in the following claims means one or more. Thus, for example, "a weaker part" means one or more weaker parts and, accordingly, a subsequent reference to "the weaker part" refers the one or more weaker parts.

The present disclosure has been shown and described with reference to the foregoing example embodiments. It is to be understood, however, that other forms, details and embodiments may be made without departing from the spirit and scope of the disclosure which is defined in the following claims.

What is claimed is:

1. A cartridge, comprising:

a housing having a chamber therein for holding a fluid;

a hole extending through the housing to the chamber; and a breachable membrane that, in an unbreached state, substantially closes the hole, the membrane resiliently configured such that, upon being breached, the membrane rebounds to a breached state only partially closing the hole, wherein the membrane is configured to become breached by being punctured and comprises a thin layer of plastic formed across the hole, wherein the membrane, in the breached state, partially closes at least 80% of the hole.

2. The cartridge of claim 1, wherein the fluid comprises ink.

3. The cartridge of claim 1, wherein the membrane, in the unbreached state, fully closes the hole.

4. The cartridge of claim 1, wherein the hole extends from a first end at an exterior of the housing to a second end at the chamber; and the membrane is located at the second end of the hole.

5. The cartridge of claim 1, wherein the breachable membrane resiliently configured comprises a plastic membrane that includes a weaker part along a first part of a periphery of the membrane and a stronger part along a second part of the periphery of the membrane, the weaker part and the stronger part occupying substantially the entire periphery of the membrane and the weaker part configured to fail under pressure significantly sooner than the stronger part.

6. The cartridge of claim 1, wherein the breachable membrane resiliently configured comprises a plastic membrane having a nominal thickness in the range of 0.005 inches to 0.015 inches.

7. A cartridge, comprising:

a housing a fluid holding chamber, the housing having a fluid fill hole therein defined by a sidewall extending from an exterior of the housing to the fluid holding chamber; and a membrane having a first, formed state substantially closing the hole, the membrane being affixed to the sidewall and configured to break away from the sidewall along a weaker part when a fluid fill tool is inserted into the hole against the membrane and to rebound at the urging of a stronger part that remains affixed to the sidewall when the fluid fill tool is withdrawn from the hole to a second, deformed state partially closing the hole, wherein the membrane is configured to be punctured to the second deformed state and comprises a thin layer of plastic formed across the hole, wherein the membrane, in the second, deformed state, partially closes at least 80% of the hole.

8. The cartridge of claim 7, wherein the fluid comprises ink.

9. The cartridge of claim 7, wherein the membrane in the first, formed state fully closes the hole.

10. The cartridge of claim 7, wherein the stronger part comprises a living hinge on which the membrane rebounds to the second, deformed state when the fluid fill tool is withdrawn from the hole.

11. The cartridge of claim 7, wherein the weaker part of the membrane comprises a first extent of a periphery of the membrane along which the membrane is thinned at a junction with the sidewall to form a locally weaker part of the membrane.

12. The cartridge of claim 7, wherein the membrane is formed as an integral part of the housing.

13. A cartridge, comprising:

a housing a fluid holding chamber, the housing having a fluid fill hole therein defined by a sidewall extending from an exterior of the housing to the fluid holding chamber; and a membrane having a first, formed state substantially closing the hole, the membrane being affixed to the sidewall and configured to become punctured when a fluid fill tool is inserted into the hole against the membrane and to rebound at the puncture site when the fluid fill tool is withdrawn from the hole to a second, deformed state partially closing the hole, wherein the membrane configured to become punctured comprises a thin layer of plastic formed across the hole and wherein the membrane, in the second, deformed state, partially closes at least 80% of the hole.

14. The cartridge of claim 13, wherein the fluid comprises ink.

15. The cartridge of claim 13, wherein the hole extends from a first end at an exterior of the housing to a second end at the chamber and the membrane is formed across the second end of the hole.

16. The cartridge of claim 13, wherein the thin layer of plastic comprises a layer of plastic having a nominal thickness in the range of 0.005 inches to 0.015 inches.

17. The cartridge of claim 1, wherein the membrane is configured to resiliently rebound upwardly against gravity to the breached state only partially closing the hole.

18. The cartridge of claim 5, wherein the stronger part has a first thickness and wherein the weaker part has a second thickness less than the first thickness.

19. A cartridge, comprising:

a housing having a chamber therein for holding a fluid;

a hole extending through the housing to the chamber; and a breachable membrane that, in an unbreached state, substantially closes the hole, the membrane resiliently configured such that, upon being breached, the membrane rebounds to a breached state only partially closing the hole, wherein the breachable membrane resiliently configured comprises a plastic membrane that includes a weaker part along a first part of a periphery of the membrane and a stronger part along a second part of the periphery of the membrane, the weaker part and the stronger part occupying substantially the entire periphery of the membrane and the weaker part configured to fail under pressure significantly sooner than the stronger part.

20. A cartridge, comprising:

a housing having a chamber therein for holding a fluid;

a hole extending through the housing to the chamber; and a breachable membrane that, in an unbreached state, substantially closes the hole, the membrane resiliently configured such that, upon being breached, the membrane rebounds to a breached state only partially closing the hole, wherein the breachable membrane resiliently configured comprises a plastic membrane having a nominal thickness in the range of 0.005 inches to 0.015 inches.

21. A cartridge, comprising:

a housing having a fluid holding chamber, the housing having a fluid fill hole therein defined by a sidewall extending from an exterior of the housing to the fluid holding chamber; and a membrane having a first, formed state substantially closing the hole, the membrane being affixed to the sidewall and configured to break away from the sidewall along a weaker part when a fluid fill tool is inserted into the hole against the membrane and to rebound at the urging of a stronger part that remains affixed to the sidewall when the fluid fill tool is withdrawn from the hole to a second, deformed state partially closing the hole, wherein the weaker part of the membrane comprises a first extent of a periphery of the membrane along which the membrane is thinned at a junction with the sidewall to form a locally weaker part of the membrane.

* * * * *

UNITED STATES PATENT AND TRADEMARK OFFICE

CERTIFICATE OF CORRECTION

PATENT NO. : 8,079,687 B2
APPLICATION NO. : 12/241403
DATED : December 20, 2011
INVENTOR(S) : Adrian J. Martinez et al.

It is certified that error appears in the above-identified patent and that said Letters Patent is hereby corrected as shown below:

In column 4, line 40, in Claim 7, after "housing" insert -- having --.

In column 5, line 4, in Claim 13, after "housing" insert -- having --.

Signed and Sealed this
Second Day of October, 2012

David J. Kappos

David J. Kappos
*Director of the United States Patent and Trademark Office*